US009046090B2

(12) United States Patent
Kao et al.

(10) Patent No.: US 9,046,090 B2
(45) Date of Patent: Jun. 2, 2015

(54) HIGH EFFICIENCY IMPELLER

(75) Inventors: Alan Lin Kao, Tulsa, OK (US); Lance Travis Robinson, Tulsa, OK (US); David Wayne Chilcoat, Jenks, OK (US)

(73) Assignee: Baker Hughes Incorporated, Houston, TX (US)

( * ) Notice: Subject to any disclaimer, the term of this patent is extended or adjusted under 35 U.S.C. 154(b) by 604 days.

(21) Appl. No.: 13/276,449

(22) Filed: Oct. 19, 2011

(65) Prior Publication Data

US 2013/0101446 A1 Apr. 25, 2013

(51) Int. Cl.

*F04B 35/04* (2006.01)
*F04D 13/08* (2006.01)
*F04D 29/24* (2006.01)

(52) U.S. Cl.

CPC ..... *F04B 35/04* (2013.01); *F04D 13/08* (2013.01); *F04D 29/245* (2013.01)

(58) Field of Classification Search

CPC ..... F01D 5/141; F03B 3/123; F04D 29/242; F04D 29/245; F04D 29/384; F04D 13/08; F04B 35/04

USPC ..... 417/53, 423.3; 416/236 R, 235

See application file for complete search history.

(56) References Cited

U.S. PATENT DOCUMENTS

| | | | | | |
|---|---|---|---|---|---|
| 1,864,803 | A * | 6/1932 | Clark | 416/236 R |
| 2,775,945 | A * | 1/1957 | Armais | 415/172.1 |
| 4,706,910 | A * | 11/1987 | Walsh et al. | 244/130 |
| 4,720,239 | A * | 1/1988 | Owczarek | 415/181 |
| 4,813,633 | A * | 3/1989 | Werle et al. | 244/130 |
| 4,981,417 | A * | 1/1991 | Arbeus | 416/186 R |
| 5,193,983 | A * | 3/1993 | Shyu | 416/236 A |
| 6,250,797 | B1 * | 6/2001 | Weetman | 366/270 |
| 6,280,144 | B1 * | 8/2001 | Powers | 416/236 A |
| 6,296,446 | B1 * | 10/2001 | Ishijima et al. | 416/236 A |
| 6,345,791 | B1 * | 2/2002 | McClure | 244/200 |
| 6,361,272 | B1 * | 3/2002 | Bassett | 415/121.1 |
| 6,431,498 | B1 | 8/2002 | Watts et al. | |
| 6,474,942 | B2 * | 11/2002 | Markytan | 415/169.2 |
| 6,676,366 | B2 | 1/2004 | Kao | |
| 6,872,048 | B2 * | 3/2005 | Uselton et al. | 415/119 |
| 7,494,325 | B2 * | 2/2009 | Gustafson et al. | 416/236 R |

(Continued)

FOREIGN PATENT DOCUMENTS

| | | |
|---|---|---|
| CA | 2659492 | 8/2003 |
| CA | 2614459 | 6/2008 |
| CA | 2656658 | 9/2010 |
| JP | 02-210188 A | 8/1990 |

OTHER PUBLICATIONS

"Open vs. Closed Impellers." Open vs. Closed Impellers. N.p., n.d. Web. Jan. 23, 2015. http://www.mcnallyinstitute.com/14-htm1/14-02.htm.*

(Continued)

*Primary Examiner* — Devon Kramer
*Assistant Examiner* — Joseph Herrmann
(74) *Attorney, Agent, or Firm* — Bracewell & Giuliani LLP

(57) ABSTRACT

An impeller vane includes at least one groove on a high pressure or working surface of the impeller vane to increase pump efficiency and reduce pump power requirements. The impeller vane includes a groove or a plurality of grooves formed on the high pressure surface of the vane. The grooves extend from a leading end of the vane to a trailing end of the vane. The grooves define ridges on either side of each groove that extend the length of the groove.

10 Claims, 5 Drawing Sheets

(56) References Cited

U.S. PATENT DOCUMENTS

| | | | | |
|---|---|---|---|---|
| 2005/0269885 | A1* | 12/2005 | Knox et al. | 310/87 |
| 2006/0060721 | A1 | 3/2006 | Watts et al. | |
| 2009/0074578 | A1 | 3/2009 | Dewar et al. | |
| 2011/0058928 | A1 | 3/2011 | Sheth et al. | |

OTHER PUBLICATIONS

Alan S. Brown, From Whales to Fans: A Second Look at a Piece of Sculpture led to a Promising Technology, Mechanical Engineering, May 2011, p. 24-29, vol. 133, No. 5.

* cited by examiner

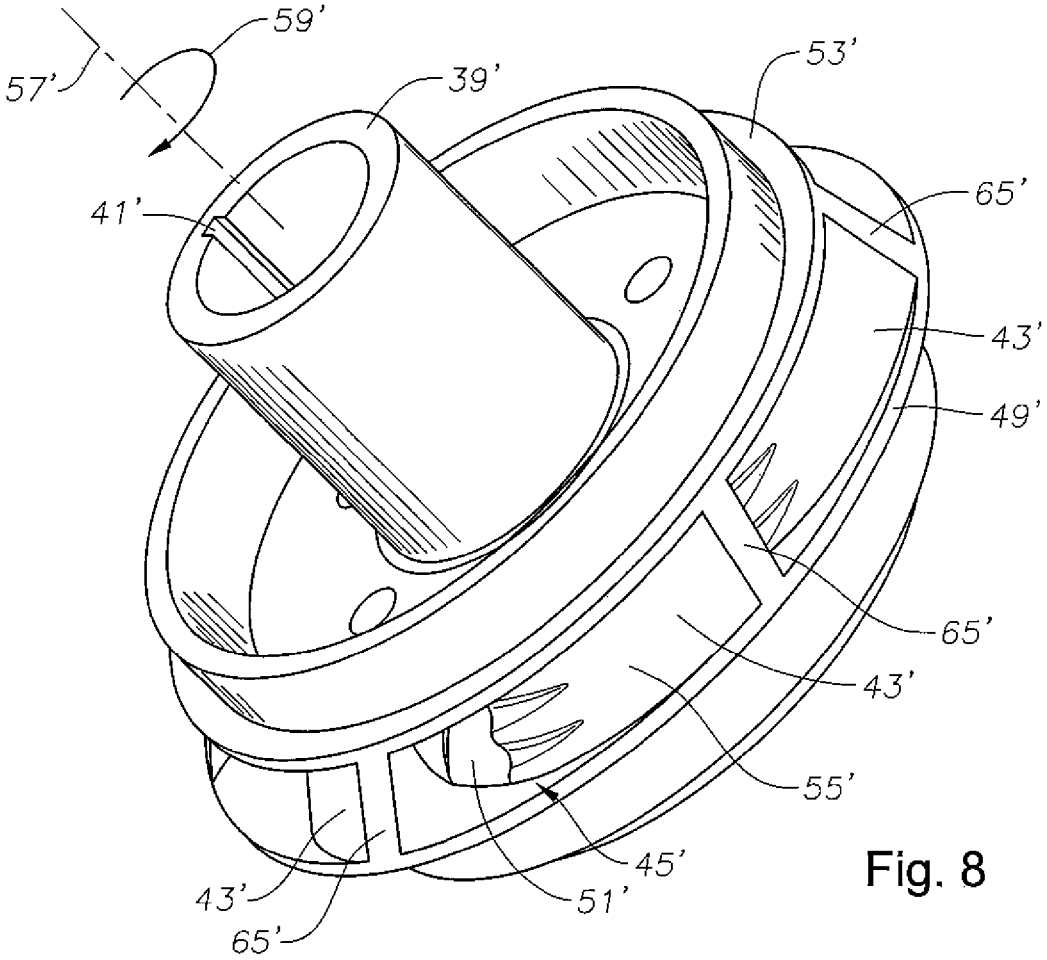
Fig. 8
Fig. 9
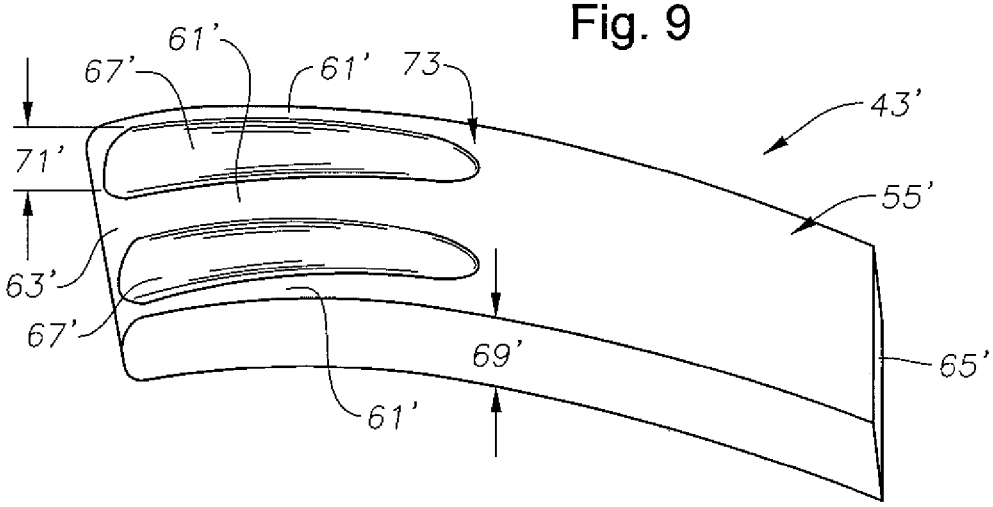

HIGH EFFICIENCY IMPELLER

BACKGROUND OF THE INVENTION

1. Field of the Invention

This invention relates in general to electric submersible pumps (ESPs) and, in particular, to a high efficiency impeller for use in an ESP.

2. Brief Description of Related Art

Electric submersible pump (ESP) assemblies are disposed within wellbores and operate immersed in wellbore fluids. ESP assemblies generally include a pump portion and a motor portion. Generally, the motor portion is downhole from the pump portion, and a rotatable shaft connects the motor and the pump. The rotatable shaft is usually one or more shafts operationally coupled together. The motor rotates the shaft that, in turn, rotates components within the pump to lift fluid through a production tubing string to the surface. ESP assemblies may also include one or more seal sections coupled to the shaft between the motor and pump. In some embodiments, the seal section connects the motor shaft to the pump intake shaft. Some ESP assemblies include one or more gas separators. The gas separators couple to the shaft at the pump intake and separate gas from the wellbore fluid prior to the entry of the fluid into the pump.

The pump portion includes a stack of impellers and diffusers. The impellers and diffusers are alternatingly positioned in the stack so that fluid leaving an impeller will flow into an adjacent diffuser and so on. Generally, the diffusers direct fluid from a radially outward location of the pump back toward the shaft, while the impellers accelerate fluid from an area proximate to the shaft to the radially outward location of the pump. Each impeller and diffuser may be referred to as a pump stage.

The shaft couples to the impeller to rotate the impeller within the non-rotating diffuser. In this manner, the stage may lift the fluid. The impeller includes vanes circumferentially spaced around the impeller. The vanes may be straight or curved. The vanes will define passages through which fluid may move within the impeller. The vanes may push fluid from the radially inward fluid inlet to the radially outward location, pressurizing the fluid. Maximum pump efficiency generally occurs at a particular flow rate or along a range of flow rates, where the range is typically significantly less than the operating range of flow rates. Pumps are usually designed to operate at or close to a maximum efficiency. However, fluid flow rates through a pump may change, such as due to depletion of fluids in a reservoir, so that over time a pump may not be operating at its maximum efficiency. A key factor in pump efficiency is the prevention of fluid boundary separation from the impeller vane. Fluid boundary separation may occur as the speed of the impeller rotation increases. When the fluid boundary separates from the surface of the impeller vane, turbulent flow is introduced, increasing drag and thus, decreasing the acceleration imparted to the fluid from the impeller vane. This decreases pump efficiency and leads to an increase in pump energy requirements. Therefore, an impeller vane that could decrease the instances of fluid boundary separation from the impeller vane and consequently increase efficiency would be desired.

SUMMARY OF THE INVENTION

These and other problems are generally solved or circumvented, and technical advantages are generally achieved, by preferred embodiments of the present invention that provide a high efficiency impeller.

In accordance with an embodiment of the present invention, an electric submersible pump (ESP) impeller is disclosed. The impeller includes a curved vane interposed between an upper shroud and a lower shroud, the vane extending radially outward from an area proximate to a cylindrical hub. A groove is formed on a convex surface of the vane, the groove extending substantially parallel with an elongate direction of the vane. A pair of ridges are formed on lateral sides of the groove.

In accordance with another embodiment of the present invention, an electric submersible pump (ESP) system is disclosed. The ESP includes a pump having an impeller for moving fluid, and a motor coupled to the submersible pump so that the motor may variably rotate the impeller in the pump. The impeller is positioned within the pump so that the impeller will accelerate fluid from a fluid inlet in the impeller toward an outer area of the pump, the impeller having at least one vane with a groove formed on a surface of the vane.

In accordance with yet another embodiment of the present invention, a method for improving pumping efficiency in an electric submersible pump assembly having a motor portion coupled to a pump portion to rotate an impeller of the pump portion in a diffuser of the pump portion is disclosed. The method rotates the impeller within the diffuser and forms a boundary layer along a vane of the impeller in response to the rotation of the impeller. The method then induces oppositely rotating vortices along the vane as the boundary layer separates from the vane, and mixes the oppositely rotating vortices along the vane to accelerate fluid flow along the vane.

An advantage of the disclosed embodiments is that they provide for higher fluid flow rates through the impeller with decreased separation from the high pressure or working surface of the impeller vane. In addition, the disclosed embodiments provide for pumps with decreased power requirements, allowing for a similar volume of fluid to be lifted from a wellbore using less energy over similar pumps having impeller vanes without the disclosed embodiments.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

FIG. 8 is a schematic representation of an alternative impeller of the electric submersible pump assembly of FIG. 1.

FIG. 9 is a schematic representation a vane of the impeller of FIG. 8.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning ESP operation, construction, and the like have been omitted inasmuch as such details are not considered necessary to obtain a complete understanding of the present invention, and are considered to be within the skills of persons skilled in the relevant art.

Figure 1:
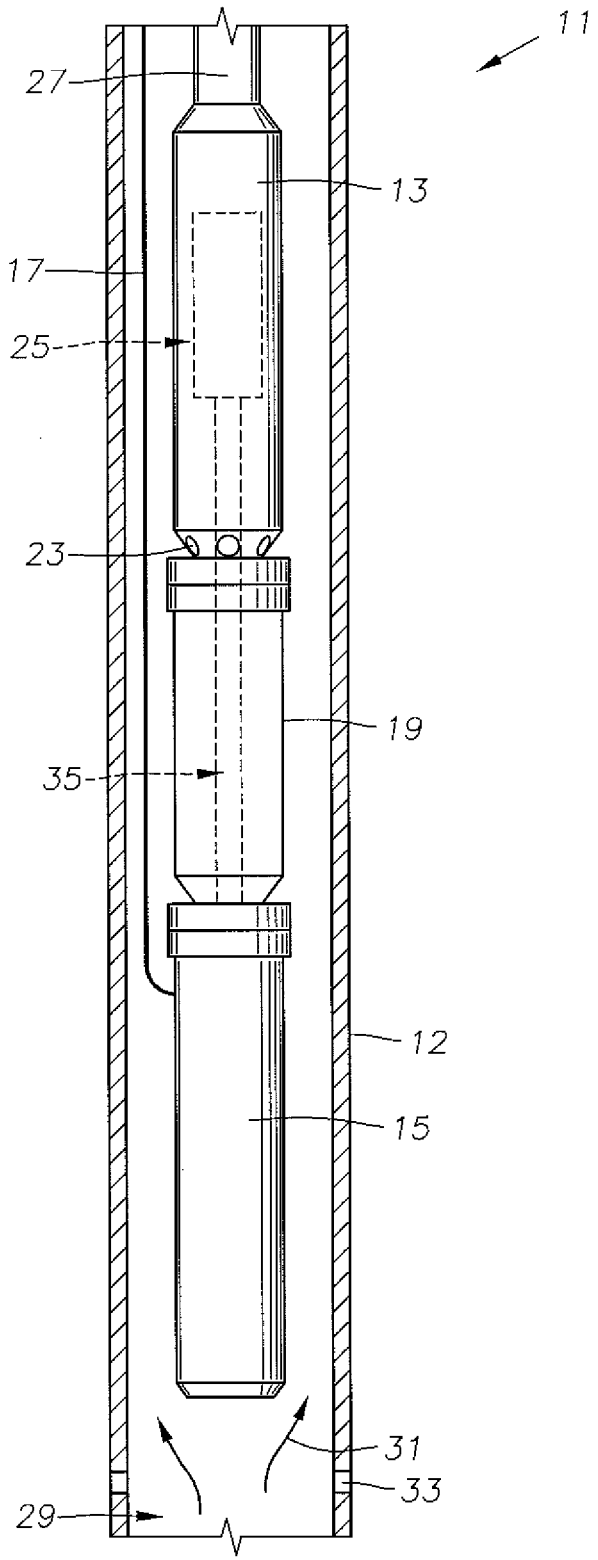
FIG. 1 is a schematic view of an electric submersible pump assembly disposed within a wellbore.

With reference now to FIG. 1 an example of an electrical submersible pumping (ESP) system 11 is shown in a side partial sectional view. ESP 11 is disposed in a wellbore 29 that is lined with casing 12. In the embodiment shown, ESP 11 includes a motor 15, a seal section 19 attached on the upper end of the motor 15, and a pump 13 above seal section 19. Fluid inlets 23 shown on the outer housing of pump 13 provide an inlet for wellbore fluid 31 in wellbore 29 to enter into pump section 13. A gas separator (not shown) may be mounted between seal section 19 and pump section 13.

In an example of operation, pump motor 15 is energized via a power cable 17. Motor 15 rotates an attached shaft assembly 35 (shown in dashed outline). Although shaft 35 is illustrated as a single member, it should be pointed out that shaft 35 may comprise multiple shaft segments. Shaft assembly 35 extends from motor 15 through seal section 19 to pump section 13. An impeller stack 25 (also shown in dashed outline) within pump section 13 is coupled to an upper end of shaft 35 and rotates in response to shaft 35 rotation. Impeller stack 25 includes a vertical stack of individual impellers alternatingly interspaced between static diffusers (not shown). Wellbore fluid 31, which may include liquid hydrocarbon, gas hydrocarbon, and/or water, enters wellbore 29 through perforations 33 formed through casing 12. Wellbore fluid 31 is drawn into pump 13 from inlets 23 and is pressurized as rotating impellers 25 urge wellbore fluid 31 through a helical labyrinth upward through pump 13. The pressurized fluid is directed to the surface via production tubing 27 attached to the upper end of pump 13.

Figure 2:
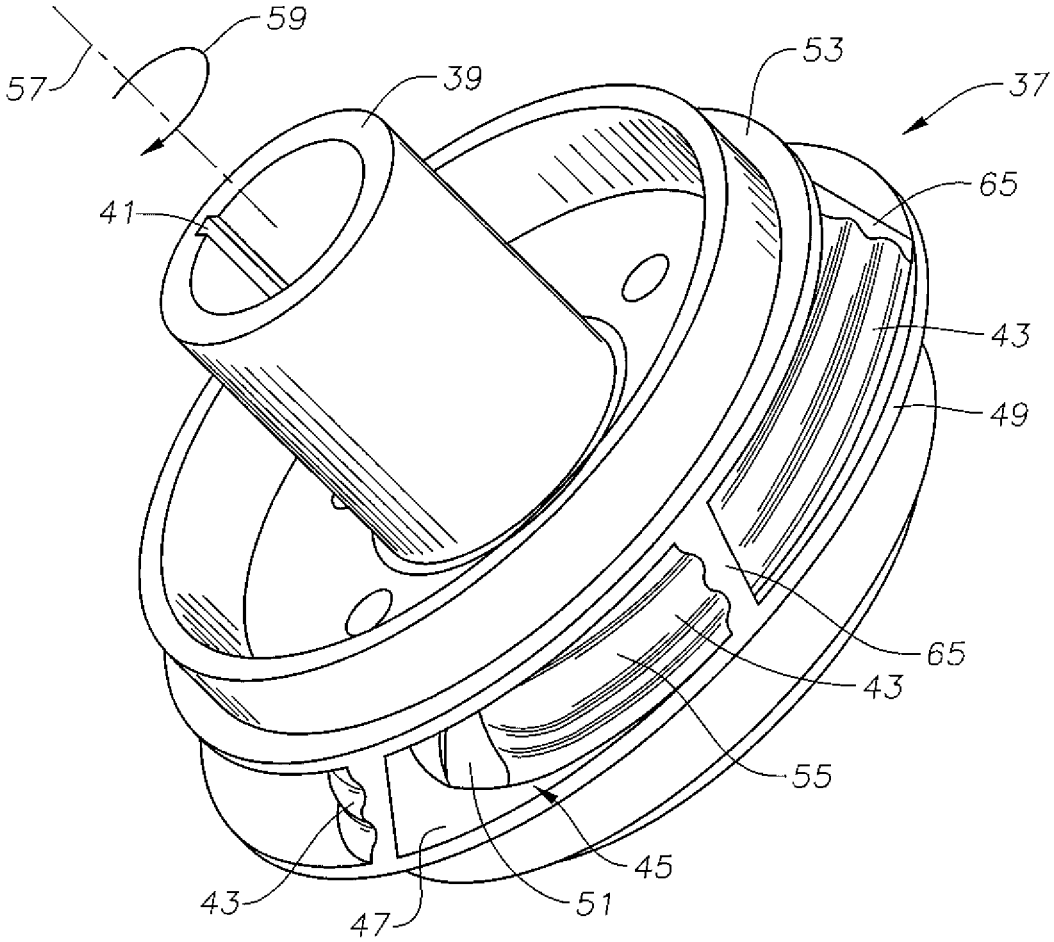
FIG. 2 is a schematic representation of an impeller of the electric submersible pump assembly of FIG. 1.

In an exemplary embodiment, impeller stack 25 includes one or more impellers 37 illustrated in FIG. 2. Impeller 37 is a rotating pump member that accelerates fluids 31 (FIG. 1) by imparting kinetic energy to fluid 31 through rotation of impeller 37. Impeller 37 has a central bore defined by the inner diameter of impeller hub 39. Shaft 35 (FIG. 1) passes through the central bore of impeller hub 39. Impeller 37 may engage shaft 35 by any means including, for example, splines (not shown) or keyways 41 that cause impeller 37 to rotate with shaft 35 (FIG. 1).

As shown in example of FIG. 2, impeller 37 includes a plurality of vanes 43. Each vane 43 curves radially outward from an interior of impeller 37 proximate to hub 39 to an impeller edge 49. Impeller vanes 43 may be attached to or integrally formed with impeller hub 39. Vanes 43 may extend radially from impeller hub 39 and may be normal to shaft 35, or may extend at an angle. In the illustrated embodiment, vanes 43 are curved as they extend from impeller hub 39 so that a convex portion of each vane 43 extends in the direction of rotation. Passages 45 are formed between surfaces of vanes 43. Impeller 37 may rotate on shaft 35 (FIG. 1) about axis 57 passing through hub 39 in the direction indicated by arrow 59. As impeller 37 rotates, fluid will be directed into passages 45 through inlet 51. Fluid will be accelerated by vane 43, causing the fluid to move along a high pressure surface 55 and out of the associated passage 45. High pressure surface 55 may be a surface of vane 43 that contacts and pressurizes fluid as described in more detail below.

A lower shroud 47 forms an outer edge of impeller 37 and may be attached to or join an edge of each vane 43. Lower shroud 47 defines a planar surface intersected by axis 57 and adjacent a lower lateral side of impeller 37. In some embodiments, lower shroud 47 is attached to impeller hub 39, either directly or via vanes 43. In some embodiments, impeller hub 39, vanes 43, and lower shroud 47 are all cast or manufactured as a single piece of material. Lower shroud 47 may have a lower lip for engaging an impeller eye washer on a diffuser. The lower lip may be formed on the bottom surface of lower shroud 47. Lower shroud 47 defines an impeller inlet 51 on a lower side of lower shroud 47. Impeller inlet 51 allows fluid flow from below impeller 37 into passages 45 defined by vanes 43.

Each impeller 37 includes impeller edge 49 that is a surface on an outer radial portion of impeller 37. In an exemplary embodiment, impeller edge 49 is the outermost portion of lower shroud 47. Impeller edge 49 need not be the outermost portion of impeller 37. The diameter of impeller edge 49 is slightly smaller than an inner diameter of a diffuser in which impeller 37 is positioned.

Further in the example of FIG. 2, impeller 37 includes an upper shroud 53 located opposite lower shroud 47 and joins an upper lateral edge of each vane 43. Upper shroud 53 generally defines an upper boundary of passages 45 between vanes 43. Upper shroud 53 may seal against an upthrust washer of a diffuser (not shown) disposed above impeller 37. A downthrust washer may be located between a downward facing surface of impeller 37 and an upward facing surface of a diffuser disposed below impeller 37.

Within a single pump housing, one or more of the plurality of impellers 37 may have a different design than one or more of the other impellers, such as, for example, impeller vanes having a different pitch. A plurality of impellers 37 may be installed on shaft 35 (FIG. 1). A plurality of diffusers are installed, alternatingly, between impellers 37. The assembly having shaft 35, impellers 37, and diffusers are installed in pump 13.

Figure 3:
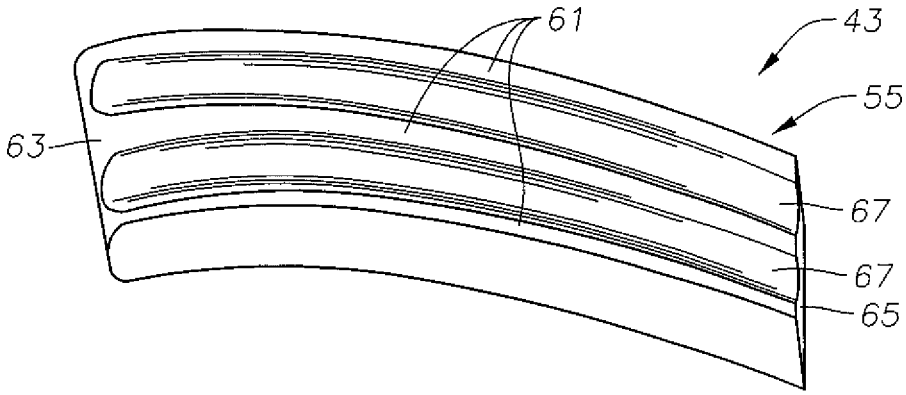
FIG. 3 is a schematic view of a vane of the impeller of FIG. 2.

Referring to FIG. 3, an exemplary portion of vane 43 is shown in a side perspective view and with a high pressure surface 55 on its outer radial periphery. As shown in FIG. 2, high pressure surface 55 may extend between lower shroud 47 and upper shroud 53. High pressure surface 55 of FIG. 3 may also be proximate to inlet 51. High pressure surface 55 includes ridges 61 shown extending radially outward and away from high pressure surface 55 into passage 45. In the illustrated embodiment, ridges 61 extend substantially the full length of vane 43 from an internal end 63 proximate to hub 39 (FIG. 2) to a trailing end 65 proximate to impeller edge 49 (FIG. 2). High pressure surface 55 may also include a groove 67 formed between each ridge 61. In the illustrated embodiment, each groove 67 is equally spaced from adjacent grooves 67 between lower shroud 47 and upper shroud 53.

Figure 4:
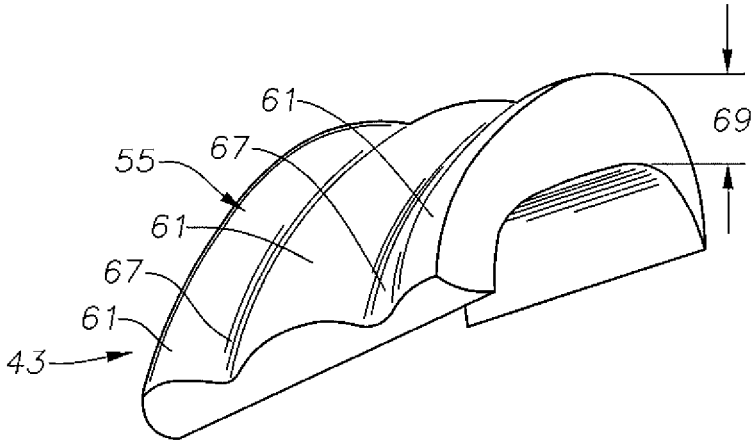
FIG. 4 is a partial top view of the vane of FIG. 3.
Figure 5:
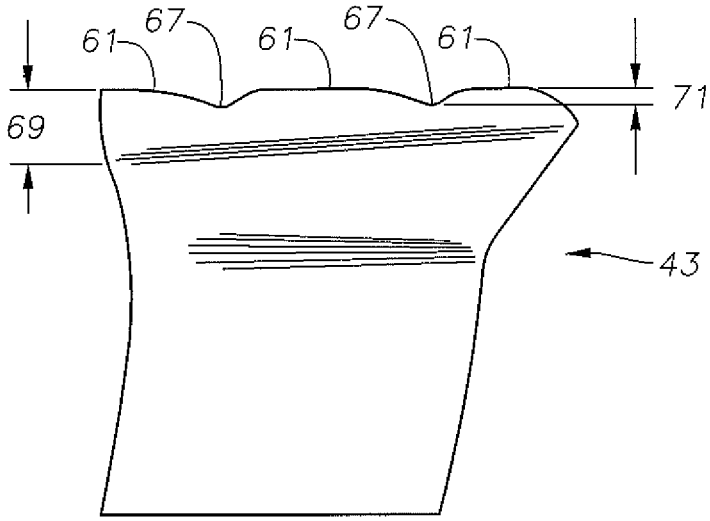
FIG. 5 is a schematic front view of the vane of FIG. 3.

Similarly, each ridge 61 is equally spaced from adjacent ridges 61 between lower shroud 47 and upper shroud 53. Each groove 67 may have a ridge 61 on either side of groove 67. As shown in FIG. 4 and FIG. 5, a width 69 of vane 43 corresponds with a maximum height of vane 43 from a side opposite high pressure surface 55 to high pressure surface 55. Each groove 67 may have a depth 71 that is approximately one third width 69 of vane 43 at the measured location. A person skilled in the art may recognize that width 69 of vane 43 may vary from internal end 63 to trailing end 65; similarly, depth 71 may vary as width 69 varies.

Figure 6:
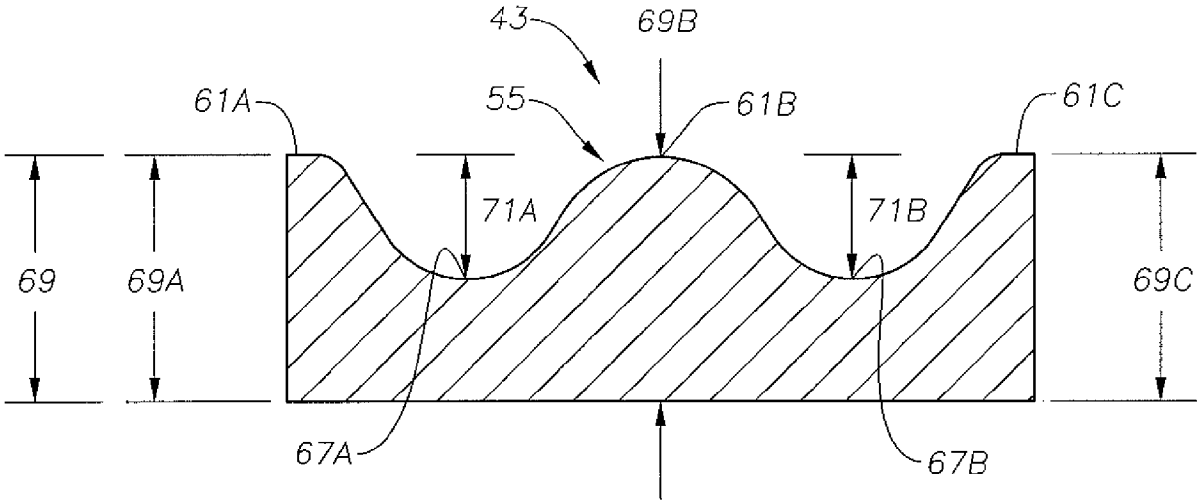
FIG. 6 is a sectional view of the vane of FIG. 4 taken along line 6-6.

Referring to FIG. 6, a sectional view of a portion of vane 43 is shown. In the exemplary embodiment, vane 43 includes three ridges 61A, 61B, and 61C, and two grooves 67A, and 67B. Ridge 61A may have a height 69A corresponding with height 69 (FIG. 4) of vane 43. Ridge 61B may have a height 69B corresponding with height 69 (FIG. 4) of vane 43. Ridge 61C may have a height 69C corresponding with height 69 (FIG. 4) of vane 43. As shown, height 69A is equivalent to height 69B and height 69C so that each ridge may be the full height 69 of vane 43. Groove 67A may have a depth 71A corresponding to depth 71 (FIG. 4) of vane 43. Similarly, groove 67B may have a depth 71B corresponding to depth 71 of vane 43. Thus, as shown in FIG. 6, grooves 67A, 67B have equivalent depths 71A, 71B that are equivalent to depth 71 of FIG. 4 and FIG. 5. As shown in FIG. 6, depths 71A, 71B are one-third heights 69A, 69B, and 69C.

Referring to FIGS. 3-5, grooves 67 allow fluid to move across vane 43 from internal end 63 to trailing end 65 at a higher speed without causing separation of flow from high pressure surface 55 normally associated with increased fluid speeds through passage 45. Generally, as a vane 43 without ridges 61 and grooves 67 rotates it will impart kinetic energy to the fluid. The kinetic energy induces fluid movement. As the fluid moves past vane 43 it will form a boundary layer of substantially laminar flow along high pressure surface 55 of vane 43. Increasing rotational speeds, such as those necessary to pressurize wellbore fluids for lifts of several thousand feet to the surface, will cause the boundary layer to separate from high pressure surface 55 and induce turbulent flow. The turbulent flow increases drag of vane 43 and, consequently, requires additional pump power or energy to overcome the drag forces.

In the illustrated embodiment of FIG. 3, as fluid accelerates over ridges 61, vortices (not shown), i.e. turbulent flow, may be formed by the fluid flow. Unlike prior art embodiments, as the vortices move along high pressure surface 55, they may flow from ridges 61 into grooves 67. As each groove 67 has a ridge 61 on either side of it, vortices may move into grooves 67 from both a side of groove 67 proximate to the lower shroud 47 and a side of groove 67 proximate to upper shroud 53 side. These vortices will have opposite rotations such that the rotation of the vortex moving from the side of groove 67 proximate to upper shroud 53 rotates in the opposite direction of the vortex moving from the side of groove 67 proximate to lower shroud 47. The vortices mix in groove 67, effectively canceling out the oppositely signed turbidity, and accelerate flow along vane 43. The mixing of the vortices will cause the fluid flow to adhere to high pressure surface 55 the length of vane 43, thereby reducing drag and increasing fluid flowrate. The disclosed embodiments reduce instances of flow separation along the length of high pressure surface 55 of vane 43 from internal end 63 to trailing end 65. Thus, the amount of kinetic energy imparted to fluid will increase allowing for acceleration of the fluid along the length of high pressure surface 55.

In an exemplary embodiment, vanes 43 having ridges 61 and grooves 67 may have a fluid flowrate that is 15% greater than the fluid flowrate of a similarly sized impeller having vanes without ridges 61 and grooves 67. In addition, an impeller 37 employing vanes 43 having ridges 61 and grooves 67 may require 10% less power to lift a similar volume of fluid than an impeller employing vanes without ridges 61 and grooves 67. A person skilled in the art will understand that alternative methods may be used to mix vortices along high pressure surface 55 and increase pump efficiency. These alternative methods are contemplated and included in the disclosed embodiments. A person skilled in the art will recognize that vane 37 has a short leading edge, internal end 63, such that high pressure surface 55 may have a length that is several times longer than internal end 63. Ridges 61 and grooves 67 may not protrude from a leading edge, or internal end 63, of vane 37. Instead, ridges 61 and grooves 67 extend along a high pressure surface 55 along a length of vane 37 between internal end 63 and trailing end 65. Still further, vane 37 may not be considered a thick object, nor will vane 37 have an airfoil profile adapted to generate lift. In addition, vane 37 may not uniformly taper to a trailing edge or external end.

Figure 7:
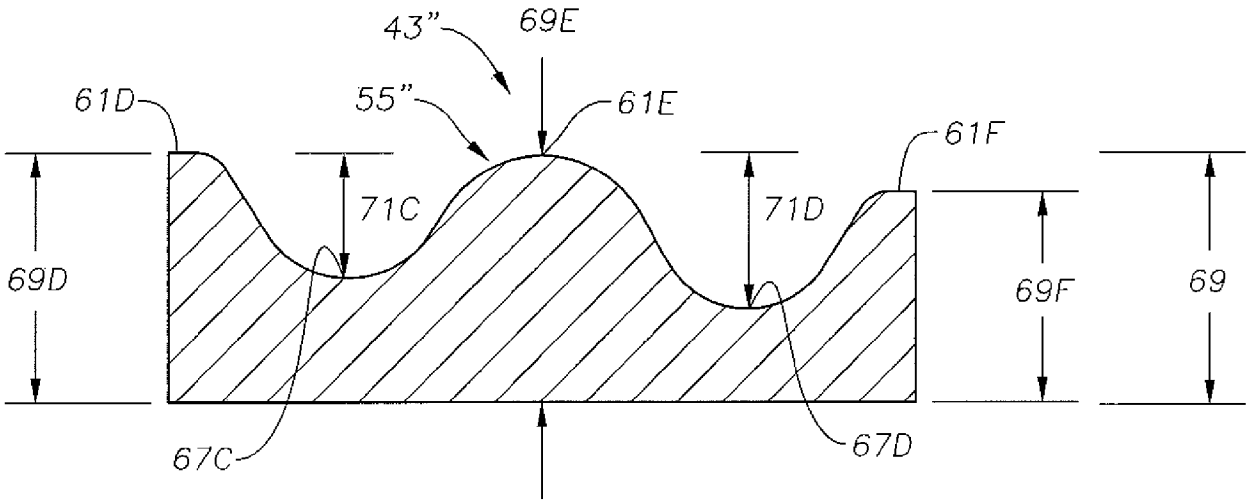
FIG. 7 is a sectional view of an alternative vane.

Referring to FIG. 7, in a sectional view of an alternative embodiment of vane 43, vane 43". Vane 43" includes three ridges 61D, 61E, and 61F, and two grooves 67C, and 67D. Ridge 61D has a height 69D. Ridge 61E has a height 69E. Ridge 61F has a height 69F. In the illustrated embodiment, height 69D and height 69E are equivalent to height 69 so that ridges 61D and 61E are a full height 69 of vane 43". As shown, height 69F may be less than height 69 so that ridge 61F is not the full height of vane 43". A person skilled in the art will understand that heights 69D, 69E, and 69F may all vary. Groove 67C has a depth 71C, and groove 67D has a depth 71D. Depth 71D may be equivalent to depth 71 of FIG. 4. Depth 71C may be less than depth 71 of FIG. 4 so that groove 67C is not as deep as groove 67D. A person skilled in the art will understand that depths 71C and 71D may vary so that neither is equivalent to height 71 of FIG. 4.

A person skilled in the art will recognize that ridges 61 and grooves 67 may extend only part of a length of vane 43 from internal end 63 to trailing end 65. For example, referring to FIG. 8, an alternative impeller 37' is shown. Impeller 37' includes the elements of impeller 37 modified as described below with respect to vanes 43'. Referring to FIG. 9, a vane 43' may be positioned within impeller 37' similar to vane 43 of impeller 37 of FIGS. 2-5. In the embodiment of FIG. 9, vane 43' has an internal end 63' that may be proximate to hub 39' of impeller 37' (FIG. 8). Vane 43' also has a trailing end 65' that will be proximate to impeller edge 49' (FIG. 8). As shown in FIG. 9, vane 43' includes grooves 67' extending from internal end 63' a portion of a length of vane 43'. Grooves 67' may have a decreasing depth 71' such that a maximum depth 71' may be at internal end 63' and depth 71' may diminish to width 69' at a location 73. Grooves 67' will define short ridges 61' as grooves 67' taper from depth 71' to height' 69' at location 73. A person skilled in the art will understand that impeller 37' and vane 43' may operate as described above with respect to FIGS. 2-5.

Accordingly, the disclosed embodiments provide numerous advantages. For example, the disclosed embodiments provide for higher fluid flow rates through the impeller with decreased separation from the high pressure or working surface of the impeller vane. In addition, the disclosed embodiments provide for pumps with decreased power requirements, allowing for a similar volume of fluid to be lifted from a wellbore using less energy over similar pumps having impeller vanes without the disclosed embodiments.

A person skilled in the art will understand that the disclosed embodiments include alternative mechanisms and apparatuses that increase pump efficiency and decrease pump power requirements by inducing oppositely spinning vortices from a separating boundary layer of a pump impeller vane. These alternative means may mix the oppositely spinning vortices to increase fluid flow rate through the impeller. These alternative means and apparatuses are contemplated and included in the disclosed embodiments.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An electric submersible pump (ESP) assembly comprising:

a pump having a plurality of stages, each stage comprising a rotatable impeller and a non-rotating diffuser;

a motor operatively coupled to the pump for rotating the impellers; wherein each of the impellers comprises:

a plurality of curved vanes interposed between an upper shroud and a lower shroud, each of the vanes curving radially outward from an area proximate to a cylindrical hub to an outer diameter of the lower shroud;

a plurality of parallel, spaced apart grooves formed in a convex surface of each of the vanes, each of the grooves extending substantially parallel with an elongate direction of the respective vane;

the plurality of parallel grooves comprising an upper groove and a lower groove, wherein each respective groove of the plurality of grooves defines a pair of ridges, one formed on the upper side of the respective groove and the other formed on the lower side of the respective groove; and wherein the ridge on the upper side of the upper groove extends from the upper shroud, and the ridge on the lower side of the lower groove extends from the lower shroud.

2. The assembly of claim 1, wherein:

each of the vanes has a high pressure side where the convex surface is located and a low pressure side opposite the high pressure side;

each of the vanes has a thickness measured between the high pressure side and the low pressure side of the vane that decreases from one of the shrouds to the other of the shrouds; and one of the ridges has a greater height measured from the low pressure side to the high pressure side of the vane than the other ridges.

3. The assembly of claim 1, wherein:

each of the grooves extends from an internal end of the vane proximate to the cylindrical hub toward a trailing end of the vane proximate to the outer diameter of the lower shroud;

the lower shroud defines a fluid inlet proximate to the cylindrical hub; and rotation of the impeller in a first direction causes fluid to flow through the fluid inlet and along the convex surface of the vane.

4. The assembly of claim 1, wherein:

each of the vanes has a high pressure side where the convex surface is located and a low pressure side opposite the high pressure side;

each of the vanes has a thickness measured between the high pressure side and the low pressure side of the vane that is greater at one of the shrouds than at the other of the shrouds; and one of the grooves has a greater groove depth than the other of the grooves.

5. The impeller of claim 1, wherein each of the grooves extends from an internal end of the vane to a predetermined location between the internal end of the vane and a trailing end of the vane.

6. An electric submersible pump (ESP) assembly comprising:

a pump having a plurality of stages for moving fluid, each of the stages comprising an impeller and a diffuser;

a motor operably coupled to the submersible pump for rotating the impellers in the pump;

each of the impellers positioned within the pump so that each of the impellers will accelerate fluid from a fluid inlet in the impellers toward an intake of a respective one of the diffusers of the pump, the impellers having a first shroud, a second shroud and a plurality of vanes interposed between the first shroud and the second shroud, the plurality of vanes extending radially outward from the fluid inlet to an outer diameter of the second shroud;

each of the vanes comprising:

an internal end at the fluid inlet and a trailing end at a periphery of the impeller;

a low pressure side and a high pressure side opposite the low pressure side and facing into a direction of rotation, the high pressure side having a convex curved surface;

a plurality of parallel, spaced apart grooves formed in the convex curved surface and extending parallel with a length of the vane, the plurality of parallel grooves comprising an upper groove and a lower groove, wherein each respective groove of the plurality of grooves defines a pair of ridges, one formed on the upper side of the respective groove and one formed on the lower side of the respective groove; and wherein the ridge on the upper side of the upper groove extends from the first shroud, and the ridge on the lower side of the lower groove extends from the second shroud.

7. The assembly of claim 6, wherein one of the ridges has a greater height than the other ridges, each ridge being measured from the low pressure side to the high pressure side of the vane.

8. The assembly of claim 6, wherein the plurality of grooves extend substantially a full length of the vane from the internal end of the vane proximate to the fluid inlet to the trailing end of the vane.

9. The assembly of claim 6, wherein the plurality of grooves extend from the internal end of the vane proximate to the fluid inlet to a predetermined location between the internal end of the vane and the trailing end of the vane.

10. The assembly of claim 6, wherein:

the ridges have rounded crests; and the grooves have rounded valleys.

* * * * *